US005993284A

United States Patent [19]

Chou

[11] Patent Number: 5,993,284

[45] Date of Patent: Nov. 30, 1999

[54] TOY AND RECIPROCATING LAMP HOLDER ARRANGEMENT

[76] Inventor: Jin-Long Chou, 10F, No. 218, Sec. 3, Da-Tung Road, Hsi-Chin Chen, Taipei Hsien, Taiwan

[21] Appl. No.: 09/090,185

[22] Filed: Jun. 4, 1998

[51] Int. Cl.[6] ..... A63H 17/28; A63H 27/18; A63H 33/22; F21V 21/34

[52] U.S. Cl. ..... 446/242; 446/238; 446/485; 362/324

[58] Field of Search ..... 446/242, 238, 446/219, 485, 236, 232; 362/286, 324, 811

[56] References Cited

U.S. PATENT DOCUMENTS

| | | | |
|---|---|---|---|
| 2,671,983 | 3/1954 | Roehrl | 446/232 |
| 3,100,365 | 8/1963 | Stadler | 446/236 |
| 4,298,868 | 11/1981 | Spurgeon | 362/811 |
| 4,381,537 | 4/1983 | Hinrichs | 362/811 |
| 4,641,831 | 2/1987 | Hughes | 446/236 |
| 5,084,803 | 1/1992 | Lan | 446/242 |
| 5,165,787 | 11/1992 | Holzhacker | 362/324 |
| 5,190,491 | 3/1993 | Connelly | 446/242 |
| 5,640,791 | 6/1997 | Fong . | |
| 5,733,167 | 3/1998 | Kroigaard | 446/485 |

*Primary Examiner*—Robert A. Hafer
*Assistant Examiner*—Kevin Hughes
*Attorney, Agent, or Firm*—Smith, Gambrell & Russell, LLP

[57] ABSTRACT

A toy and reciprocating lamp holder arrangement includes a toy body holding a power drive, and a lamp holder unit coupled to the power drive, the lamp holder unit including a shell, two eccentric wheels revolvably mounted inside the shell, a shaft coupled between the eccentric wheels, a gear transmission mechanism driven by the power drive to turn the eccentric wheel and the shaft, and a plurality of cylindrical lamp holders arranged around the shaft between the eccentric shells coupled to respective annular tracks on the eccentric wheels, the cylindrical lamp holders being reciprocated along radial guide grooves on the shell when the power drive is started.

3 Claims, 5 Drawing Sheets

TOY AND RECIPROCATING LAMP HOLDER ARRANGEMENT

BACKGROUND OF THE INVENTION

The present invention relates to a toy and reciprocating lamp holder arrangement which comprises a toy body holding a power drive, and a lamp holder unit holding a plurality of radially arranged cylindrical lamp holders, the lamp holders being reciprocated when the power drive is started.

Various toys are known having movable parts driven by power drive means carried thereon through transmission means. These toys are less attractive because they are simply driven to turn or to oscillate movable parts thereof.

SUMMARY OF THE INVENTION

The present invention provides a toy which comprises a toy body holding a power drive, and a lamp holder unit holding a plurality of radially arranged cylindrical lamp holders, that are reciprocated when the power drive is started. According to the present invention, the cylindrical lamp holders are arranged around a shaft between two eccentric shells within a shell. One eccentric shell is coupled to the power drive by a gear. The cylindrical lamp holders each have a transverse rod coupled to respective annular tracks on the eccentric wheels, and two opposite longitudinal guide plates coupled to respective radial guide grooves on the shell. When the power drive is started, the eccentric wheels are rotated, thereby causing the cylindrical lamp holders to be reciprocated along the radial guide grooves on the shell.

DETAILED DESCRIPTION OF THE PREFERRED EMBODIMENT

Figure 1:
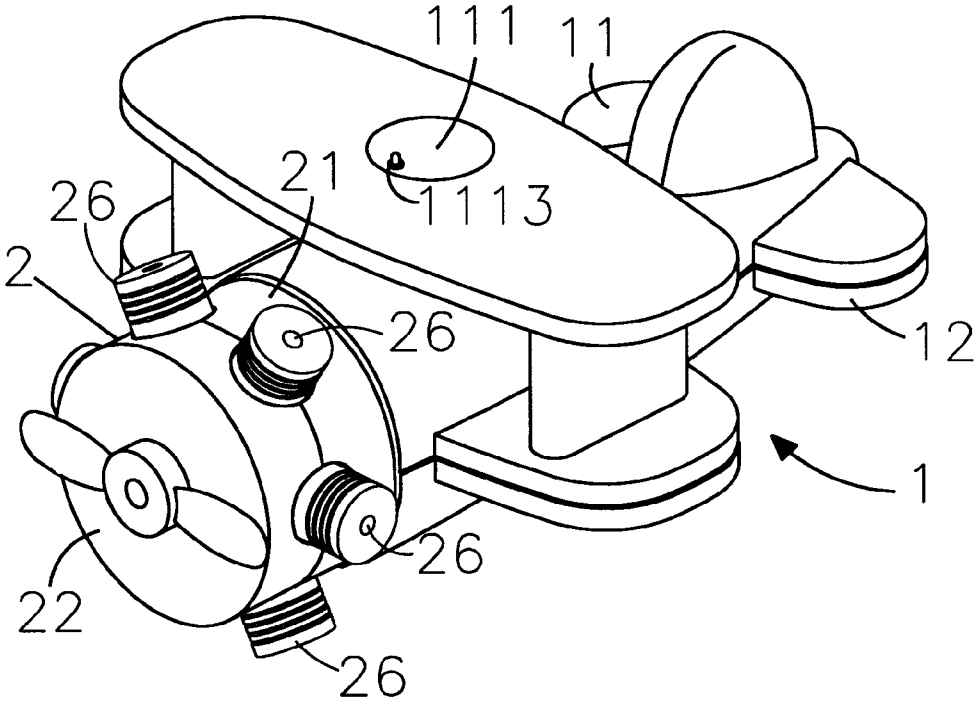
FIG. 1 is a perspective view of the present invention.
Figure 2:
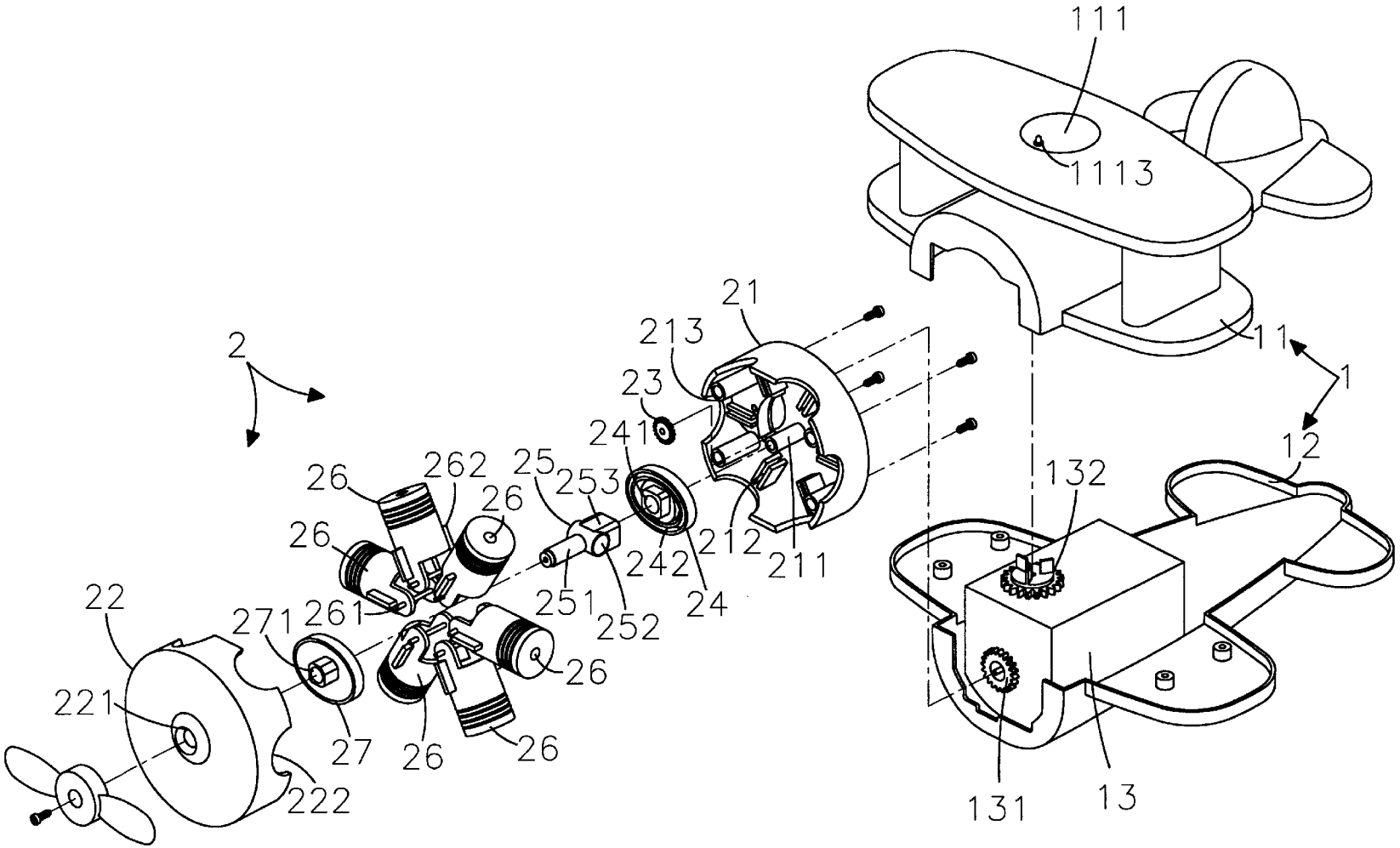
FIG. 2 is an exploded view of the present invention.

Referring to FIGS. 1 and 2, a toy and reciprocating lamp holder arrangement in accordance with the present invention is generally comprised of a toy body 1, and a lamp holder unit 2 mounted in the toy body 1.

Figure 3:
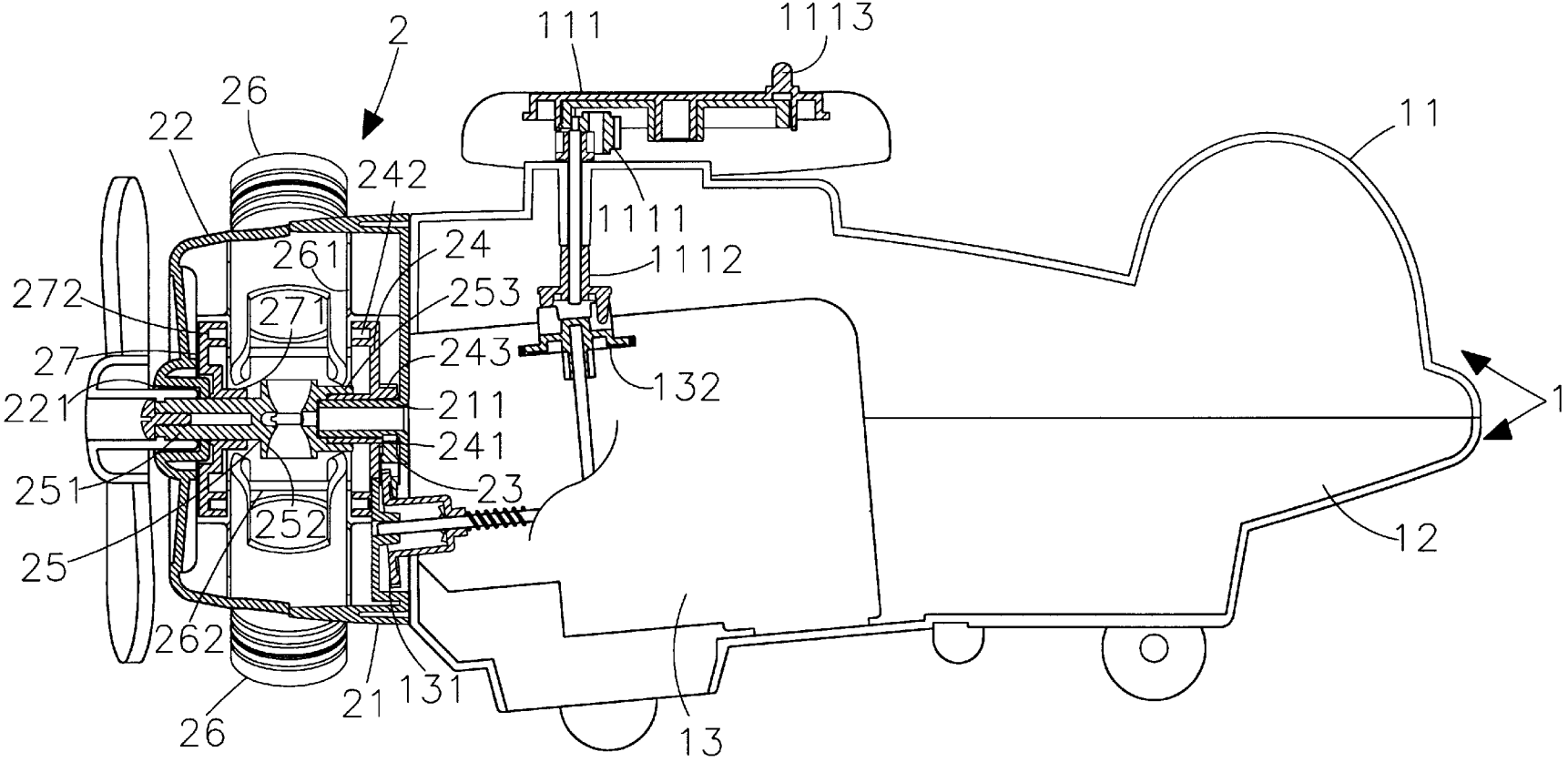
FIG. 3 is a sectional side view in an enlarged scale of the present invention.

Referring to FIG. 3 and FIGS. 1 and 2 again, the toy body 1 is shaped like a biplane, comprised of an upper shell 11, a bottom shell 12, and a power drive 13 mounted in between the upper shell 11 and the bottom shell 12. The power drive 13 comprises a first output gear 131 at a front side thereof, and a second output gear 132 at a top side thereof. The first output gear 131 is meshed with a power input gear 23 of the lamp holder unit 2. The upper shell 11 is mounted with a rotating wheel 111. The rotating wheel 111 has a mounting rod 1113 raised from the top at an eccentric location for holding an ornament (not shown). The second output gear 132 is coupled to a link gear 1112. The link gear 1112 is driven by the second output gear 132 to rotate the rotating wheel 111 through a gear 1111.

The lamp holder unit 2 comprises a rear cover 21, a front cover 22, a power input gear 23, a first eccentric wheel 24, a hollow shaft 25, a plurality of for example six cylindrical lamp holders 26, and a second eccentric wheel 27. The power input gear 23 is mounted on the rear cover shell 21, and meshed between the first output gear 131 of the power drive 13 and a transmission gear 243 at the back side of the first eccentric wheel 24. The hollow shaft 25 has a shaft body 253 mounted on a tubular coupling portion 241 of the first eccentric wheel 24. The tubular coupling portion 241 of the first eccentric wheel 24 is coupled to a forwardly extended axle 211 of the rear cover shell 21. The hollow shaft 25 has a front extension rod 251 forwardly extended from the shaft body 253. The front extension rod 251 is inserted through an axle hole 271 on the second eccentric wheel 27, and then fastened to a center hole 221 on the front cover shell 22 by a screw. The cylindrical lamp holders 26 are radially equiangularly arranged around the hollow shaft 25 between the eccentric wheels 24;27, each having a transverse rod 261 at one end, and two longitudinal guide plates 262 at two opposite sides. The opposite ends of the transverse rods 261 of the cylindrical lamp holders 26 are respectively slidably coupled to annular tracks 242;272 on the eccentric wheels 24;27. The guide plates 262 of the cylindrical lamp holders 26 are respectively coupled to radial guide grooves 212 on the rear cover shell 21 and corresponding radial guide grooves (not shown) on the front cover shell 22. The other ends (namely, top ends) of the cylindrical lamp holders 26 are extended out of respective semi-circular openings 213 on the rear cover shell 21 and respective semi-circular openings 222 on the front cover shell 22. The hollow shaft 25 further comprises two lenses 252 bilaterally disposed on the middle between the shaft body 253 and the front extension rod 251, and a light source (not shown) on the inside. When the light source is turned on, light passes from the light source through the lens means 252 to the inside of the cylindrical lamp holders 26.

Figure 4:
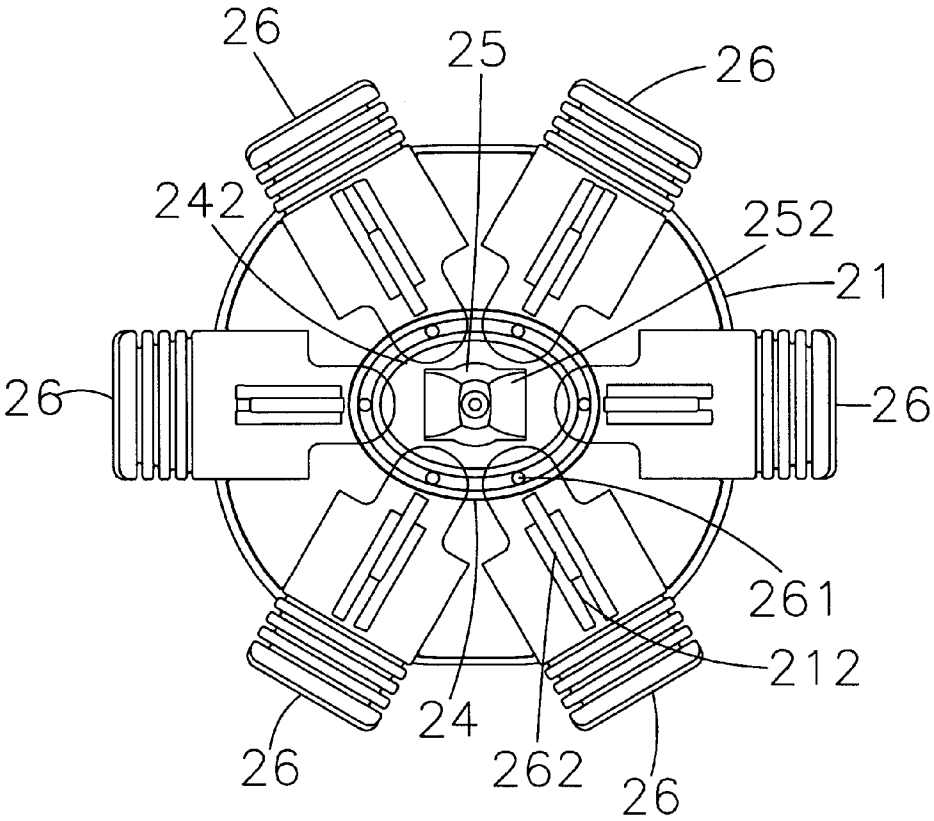
FIG. 4 is a cross sectional view of a part of FIG. 3 showing the return stroke of the cylindrical lamp holders.
Figure 5:
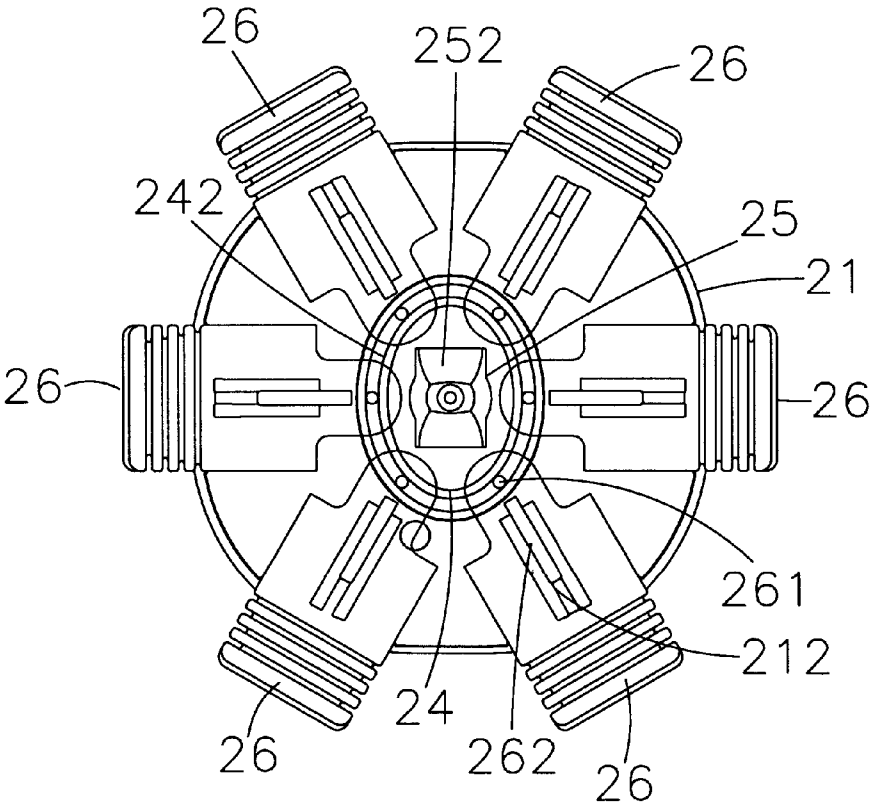
FIG. 5 is similar to FIG. 4 but showing the forward stroke of the cylindrical lamp holders.

Referring to FIGS. 4 and 5 and FIG. 3 again, when the power drive 13 is started, the first output gear 131 and the second output gear 132 are driven to turn the power input gear 23 of the lamp holder unit 2 and the link gear 1112. When the link gear 1112 is rotated, the gear 1111 is driven to rotate the rotating wheel 111. When the power input gear 23 is rotated the gear 243 is synchronously rotated, thereby causing the eccentric wheels 24;27 and the hollow shaft 25 to be turned with the gear 243. When the hollow shaft 25 is turned round and round, the cylindrical lamp holders 26 are reciprocated radially.

While only one embodiment of the present invention has been shown and described, it will be understood that various modifications and changes could be made thereunto without departing from the spirit and scope of the invention disclosed.

What the invention claimed is:

1. A toy and reciprocating lamp holder arrangement comprising:

a toy body, said toy comprising a bottom shell, an upper shell covered on said bottom shell, and a power drive mounted in between said upper shell and said bottom shell, said power drive comprising at least one output gear; and a lamp holder unit coupled to said toy body and rotated by one of said at least one output gear, said lamp holder unit comprising a rear cover shell, a front cover shell covered on said rear cover shell, said front cover shell and said rear cover shell each having a plurality of radial guide grooves on the inside and a plurality of equiangularly spaced openings at the periphery, a power input gear revolvably supported on said rear cover shell and meshed with one of said at least one power output gear of said power drive, a first eccentric wheel revolvably supported on said rear cover shell on the inside, said first eccentric wheel having a gear meshed with said power input gear, a hollow shaft coupled to said first eccentric wheel, a second eccentric wheel coupled to said hollow shaft, said first eccentric wheel and said second eccentric wheel each having an annular track at an inner side, and a plurality of cylindrical lamp holders arranged around said hollow shaft and extended out of the openings on said front cover shell and said rear cover shell, said cylindrical lamp holders each having a transverse rod coupled to the annular tracks on said front and rear cover shells and two opposite longitudinal guide plates respectively coupled to the radial sliding grooves on said front and rear cover shells, said first and second eccentric wheels being turned with said hollow shaft by said power input gear when said power drive is started, thereby causing said cylindrical lamp holders to be radially reciprocated along the radial guide grooves on said front and rear cover shells.

2. The toy and reciprocating lamp holder arrangement of claim 1 wherein said hollow shaft comprises light source means on the inside, and two lenses bilaterally disposed around said light source means for focusing light from said light source means onto said cylindrical lamp holders.

3. The toy and reciprocating lamp holder arrangement of claim 1 wherein said upper shell of said toy body comprises a rotating wheel, and a gear transmission mechanism coupled to one of said at least one power output gear of said power drive and driven by it to rotate said rotating wheel, said rotating wheel having a mounting rod raised from a top side thereof at an eccentric location for holding an ornament.

* * * * *